US007102583B1

(12) United States Patent
Lee

(10) Patent No.: US 7,102,583 B1
(45) Date of Patent: Sep. 5, 2006

(54) MULTI-BAND ANTENNA HAVING A REFLECTOR

(75) Inventor: Chang-Jung Lee, Taoyuan (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/079,761

(22) Filed: Mar. 14, 2005

(30) Foreign Application Priority Data

Mar. 16, 2004 (CN) ..... 93 1 07030

(51) Int. Cl.
*H01Q 13/00* (2006.01)

(52) U.S. Cl. ..... 343/780

(58) Field of Classification Search ..... 343/772, 343/775, 780, 781 R, 784, 789, 840
See application file for complete search history.

(56) References Cited

U.S. PATENT DOCUMENTS 4,297,710 A * 10/1981 Dupressoir ..... 343/756
5,423,072 A * 6/1995 Iwashita et al. ..... 455/67.14
6,181,293 B1 * 1/2001 Muhlhauser et al. ..... 343/840
6,275,196 B1 * 8/2001 Bobier ..... 343/840
6,977,624 B1 * 12/2005 Szente et al. ..... 343/834

* cited by examiner

*Primary Examiner*—Shih-Chao Chen
*Assistant Examiner*—Minh Dieu
(74) *Attorney, Agent, or Firm*—Thomas, Kayden, Horstemeyer & Risley

(57) ABSTRACT

A multi-band antenna with a reflector, comprising a box-shape reflector, wherein the box-shape reflector includes a base plate, a surrounding sidewalls and an extending plate, wherein the extending plate and the base plate are respectively attached on both sides of the surrounding sidewalls, thereby forming a box-shape with a receiving area on an inner surface of the base plate, and the extending plate is substantially parallel to the base plate; and a radiation unit coupled to the inner surface and substantially parallel to the base plate.

12 Claims, 8 Drawing Sheets

MULTI-BAND ANTENNA HAVING A REFLECTOR

FIELD OF INVENTION

The present invention relates to an antenna apparatus, and more particularly, to a multi-band antenna having a box-shape reflector.

BACKGROUND OF THE INVENTION

Various types of antennas are rapidly improvement along with the development of the communication technology. The IC technology is also developed with fast pace to provide a product with smaller size and lighter weight. The volume fact is one of important considerations to the antenna used for transmitting and receiving signal. One goal of the manufacture is to achieve the small product with light weight.

Antenna is employed to transmit or receive EM wave for communication technology. The characters of the antenna can be obtained from the operating frequency, radiation pattern, return loss and antenna Gain. Small size, good performance and low cost are the most important facts for the current antenna to share larger marketing.

I general, the antennas employ a reflector to reflect the EM wave transmitted by the antennas for directing the EM wave towards a pre-determined direction. In order to constrain the EM wave direction, the reflector is configured with a spherical shape or other curved surface, generally. The waves reflected from the above reflector may propagate towards a direction so as to improve the directivity and gains.

However, the well-known reflectors are shaped as spherical shape or parabolic shape or other curved surface. In order to precisely control the focus location of the reflector, it leads to the manufacture procedure is complicated; therefore, the cost is high. Further, it is also unlikely to minimize the size of such reflector.

Further, the conventional reflector is adapted to single one band only, it is impossible to be applied to the wireless transmission standard such as IEEE 802.11a and European HYPERLAN standard (4.9 GHz~5.9 GHz), IEEE 802.11b (2.4–2.5 GHz). Therefore, the conventional one is not only inconvenient, but also expensive.

Thus, what is desired is to develop a multi-band antenna to meet the requirement of improved reflection effect, easy to manufacture and is adapted to the IEEE 802.11a/b and European HYPERLAN standard.

SUMMARY OF THE INVENTION

The object of the present invention is to provide a multi-band antenna with a reflector.

The present invention discloses a multi-band antenna with a reflector comprising: a box-shape reflector, wherein the box-shape reflector includes a base plate, a surrounding sidewalls and an extending plate. The extending plate and the base plate are respectively attached on both sides of the surrounding sidewalls, thereby forming a box-shape with a receiving area on an inner surface of the base plate, and the extending plate is substantially parallel to the base plate; a signal radiation unit (antenna) is coupled to the inner surface and substantially parallel to the surface of the base plate. The radiation unit is shelter by the box-shape.

The extending plate maybe a frame structure for instance. The material of the box-shape reflector could be conductive material such as metal or alloy. The multi-band antennal is adapted to 802.11 a/b/g or HYPERLAN standard and the radiation unit is an omni-directional antenna or a dual sleeve dual antenna. The radiation unit may keep a distance to the base plate. The distance is about 2–5 cm. In one embodiment, the radiation unit is coupled to geometry center area of the base plate and the surface area of the receiving area is about one fourth of the one of the base plate. The shape of the base plate is substantially square or rectangular for a preferred embodiment.

DETAILED DESCRIPTION OF THE PRESENT INVENTION

Figure 1A:
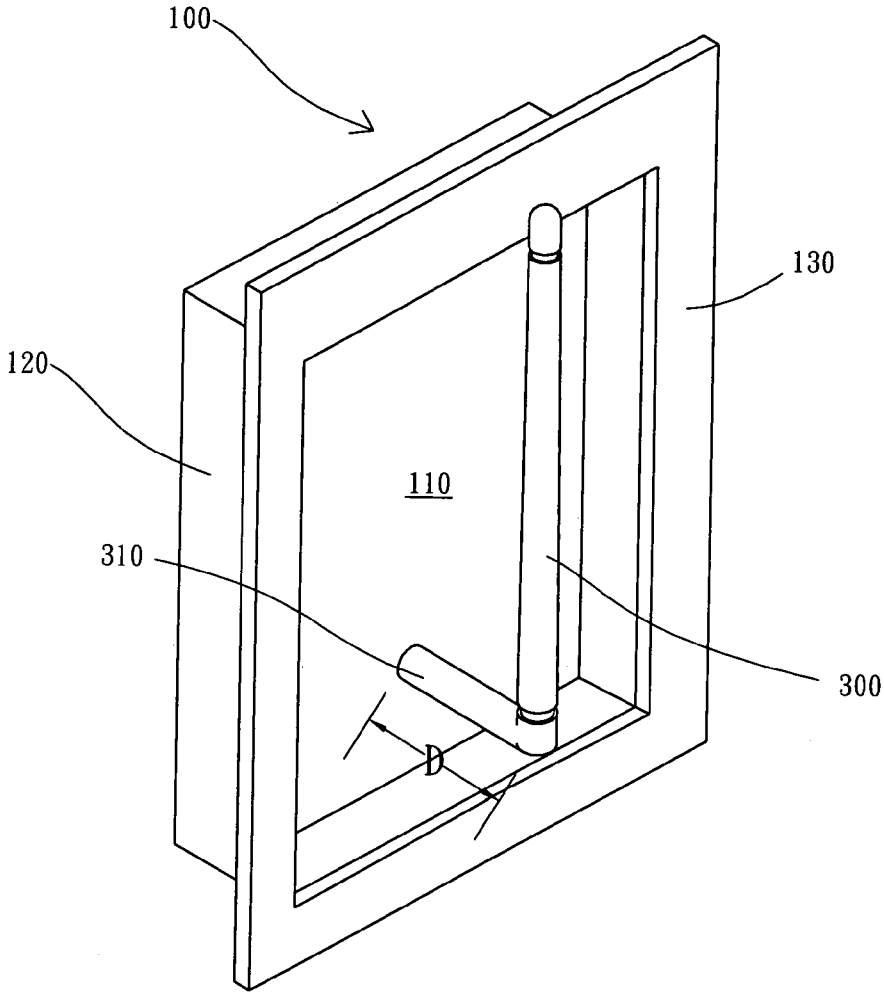
FIG. 1A illustrates the configuration of the antenna according to the present invention.
Figure 1B:
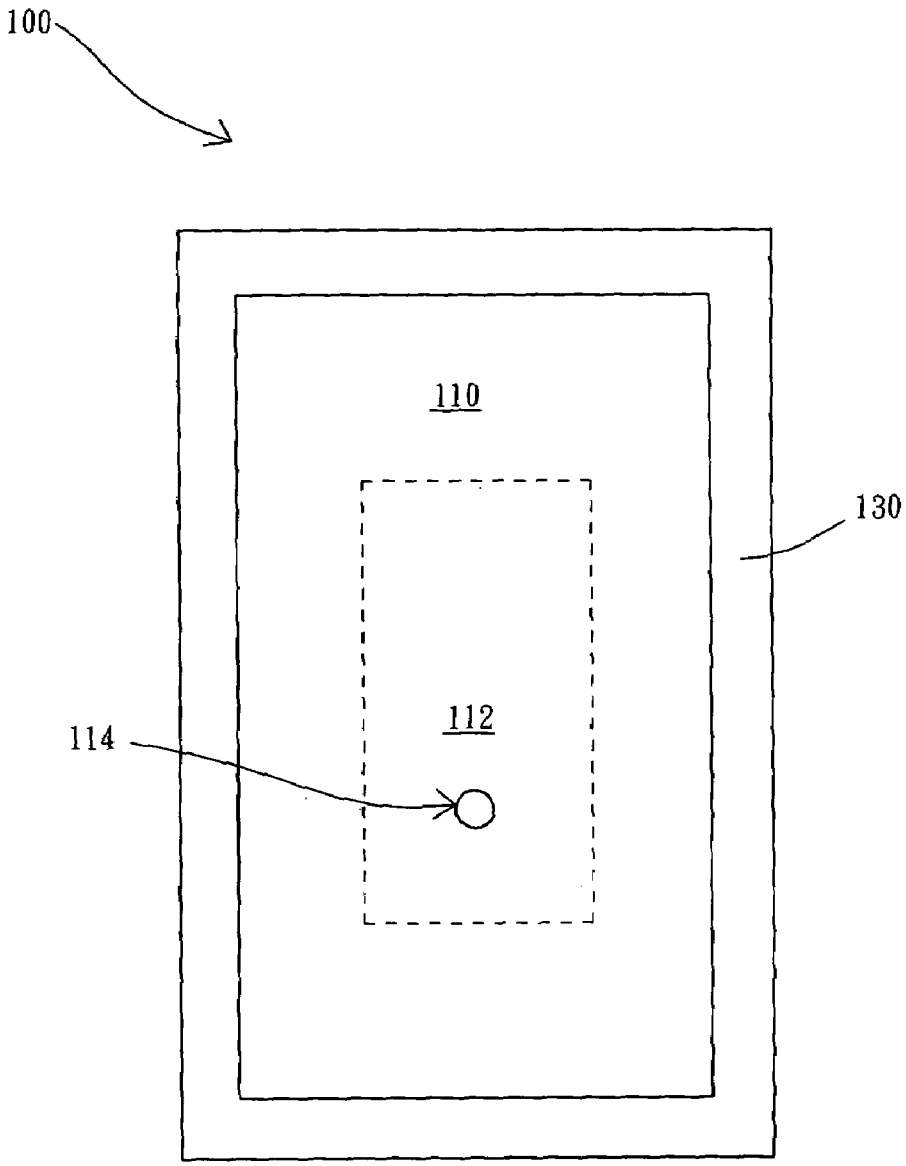
FIG. 1B illustrates the configuration of the box-shape reflector according to the present invention.

Please refer to FIGS. 1A and 1B, they illustrate the preferred embodiment of the present invention. The multi-band antenna apparatus includes a box-shape reflector 100 and an antenna component 300 (radiation unit). The box-shape reflector 100 is constructed by a base plate 110, surrounding sidewalls 120 and an extending plate 130. The extending plate 130 is attached on one end of the surrounding sidewalls 120 and the opposition side of the sidewalls has the base plate 110 attached thereon, thereby constructing the box-shape structure. The surface of the extending plate 130 is substantially parallel to the one of the base plate 110 and extending outwardly from the box-shape. The antenna 300 faces to and connected to a connection (receiving) area 112 of the base plate 110 through a connecting element 310 that plugs into a connecting opening 114 (FIG. 1B). The radiation unit is substantially parallel to the surface of the base plate 110. The connection area 112 of the base plate 110 is lower than the central point area of the base plate 110. The area of the connection area 112 is substantially ¼ of the one of the base plate 110. The antenna 300, (radiation unit) is spaced apart from the base plate 110 with a distance D. By adjusting the D, the incident angle of the EM wave into the box can be controlled, thereby controlling the radiation pattern of the antenna 300. The preferred distance of D is substantially from 2 to 5 cm. In a preferred embodiment, the length of the box-shape reflector structure is about 13 to 26 cm. It should be noted, one side of the radiation pattern is substantially shielded by the base plate 110. The antenna 300 could be located within the box or outside of the box depending on the necessary.

Figure 2:
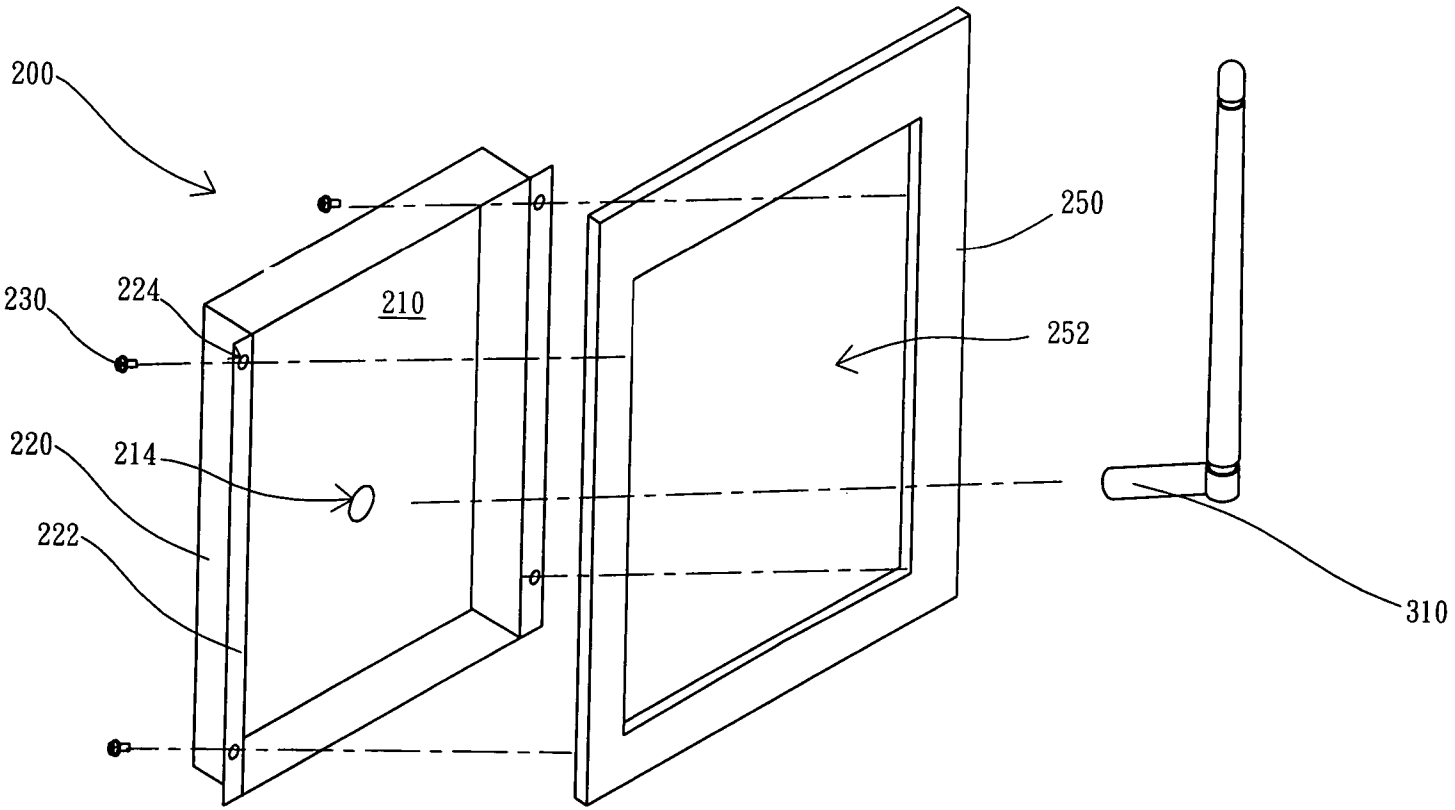
FIG. 2 illustrates the three-dimension drawing of the antenna according to the present invention.

The box-shape structure could be formed by single one piece or constructed by pluralities of parts. Please refer to FIG. 2, a further embodiment is illustrated. The extending plate 250 could be a frame type structure has an opening 252, wherein the size of the opening 252 is substantially the same with the size of the receiving space of the box. Box-shape reflector 200 is constructed by the base plate 210 and the surrounding sidewalls 220. Protruding fringes 222 are attached at the edge of the surrounding sidewalls 220, holes 224 are formed on the protruding fringes 222. Therefore, pluralities of fixing elements 230 may be used to fix or secure the extending frame 250 on the protruding fringes 222 through the holes. The antenna 300 is connected to the connecting hole 214 of the base plate 210 via the connecting element 310.

The receiving space or inner space of the box-shape reflector according to the present invention may restrict the propagation direction of the EM wave transmitted by the antenna. The perpendicular incident wave will be reflected from the base plate out of the box, directly. If the EM wave is incident with an angle to the normal line of the base plate, the EM wave will be reflected to other direction. By the assistance of the extending frame, the directivity and gains can be improved.

Beside, the material of the box-shape reflector and the extending frame are metal or other material that could reflect the EM wave, preferably. Further, the shape of the box could be square, circle, ellipse or the like. The opening shape of the extending frame could be square, circle, ellipse or the like. A fixing base could be provided to the reflector so as to set the reflector on other structure. The antenna of the present invention could be an omni-direction antenna, a sleeve antenna or other directional antenna.

Figure 3:
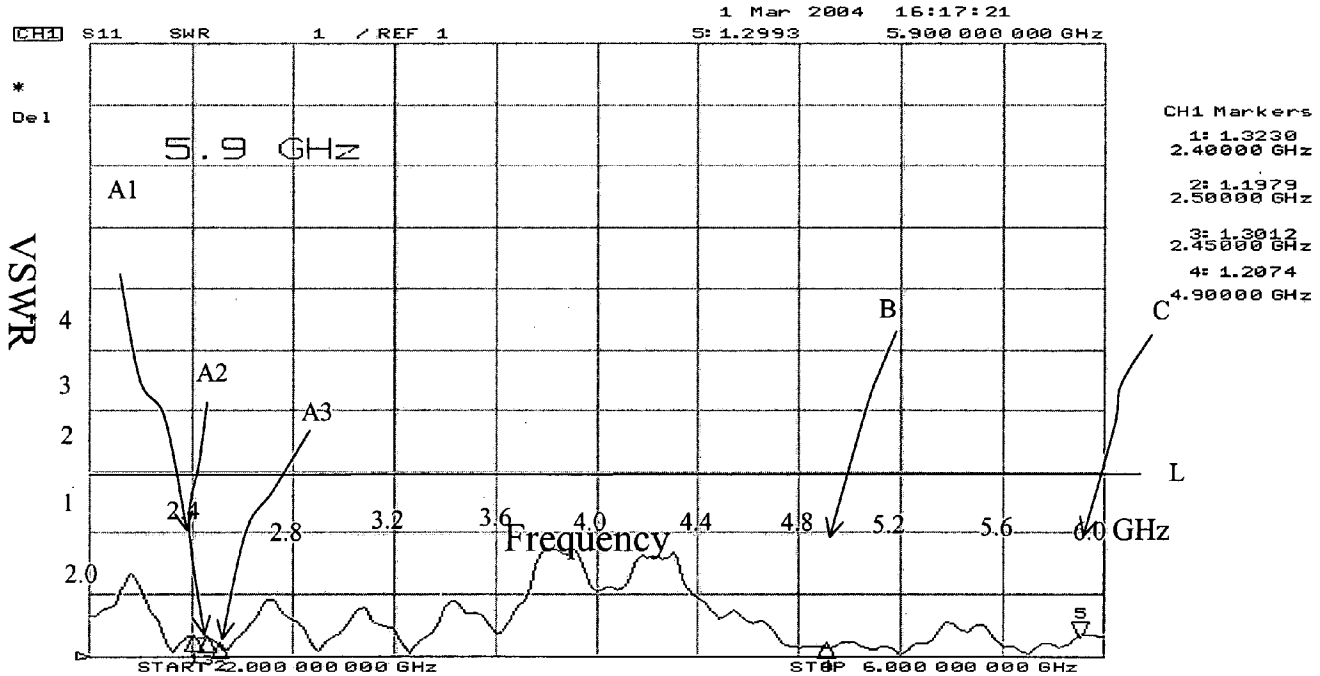
FIG. 3 illustrates standing wave ratio according to the present invention.

After the actual measurement, the present invention has the multi-band characteristic. Turning to FIG. 3, it shows the standing wave-frequency illustration. When the operating frequency is about 2.4 GHz (A1), the standing wave ratio is about 1:1.323, while the operating frequency is about 2.45 GHz (A2), the standing wave ratio is about 1:1.3012. If the operating frequency is about 2.5 GHz (A3), the standing wave ratio is about 1:1.1979. The standing wave ratio is about 1:1.12074 when the operating frequency is about 4.9 GHz (B), as shown in the drawings, the standing wave ratio is about 1:1.12993 when the operating frequency is about 5.9 GHz (C). If the standing wave ratio 1:1.5 is used as the base line. The operating points A1, A2, A3 meet the requirement of the IEEE 802.11b/g (2.4–2.5 GHz). The operating point B meets the requirement of the IEEE 802.11a (4.9 GHz), while operating point C meets the requirement of HYPERLAN standard (5.9 GHz).

Figure 4A:
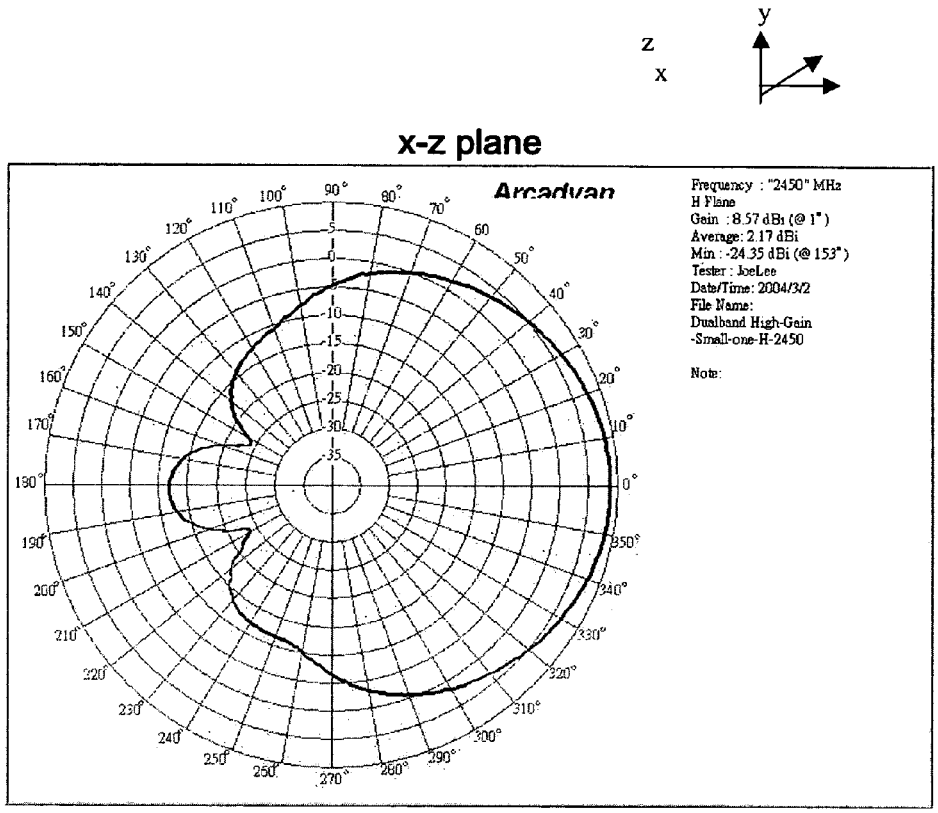
FIG. 4A illustrates the x-z radiation pattern under 2.450 GHz operation frequency according to the present invention.
Figure 4B:
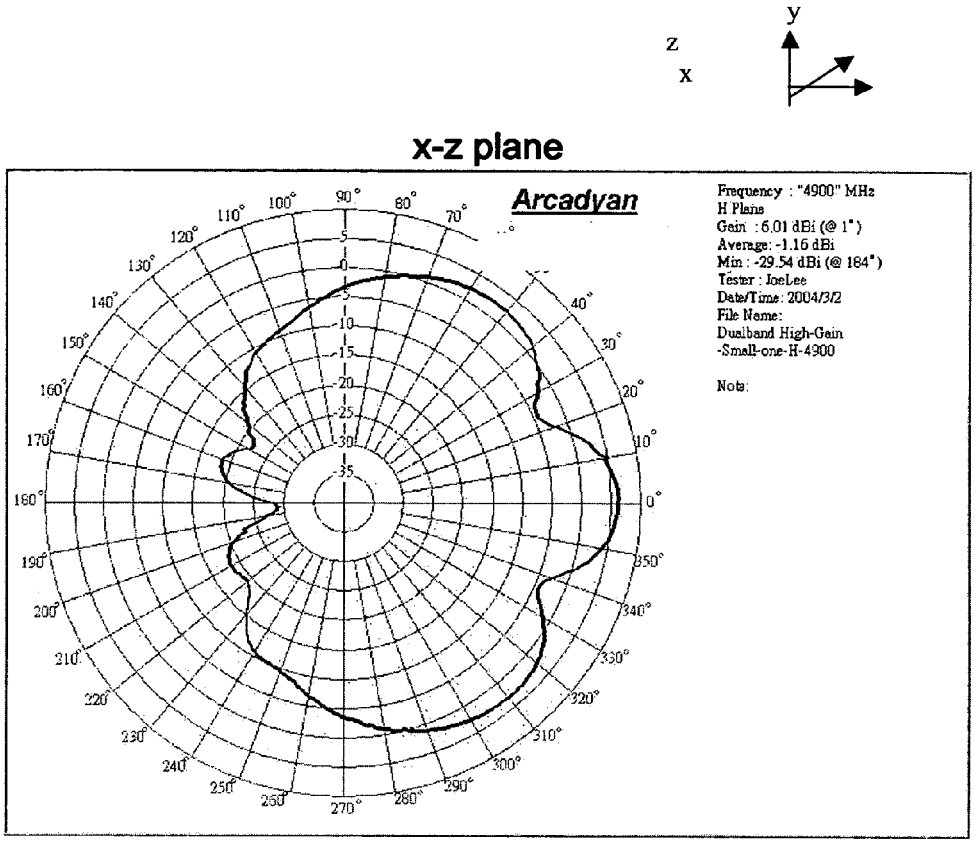
FIG. 4B illustrates the x-z radiation pattern under 4.90 GHz operation frequency according to the present invention.
Figure 4C:
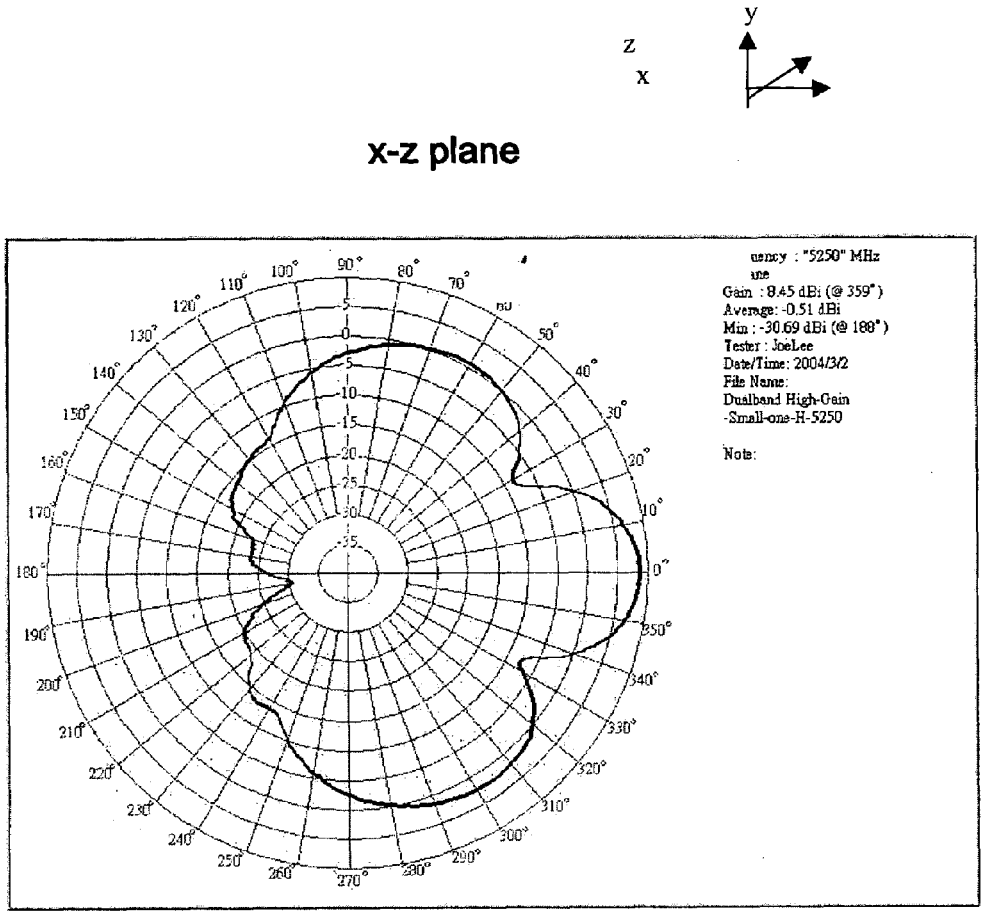
FIG. 4C illustrates the x-z radiation pattern under 5.250 GHz operation frequency according to the present invention.
Figure 4D:
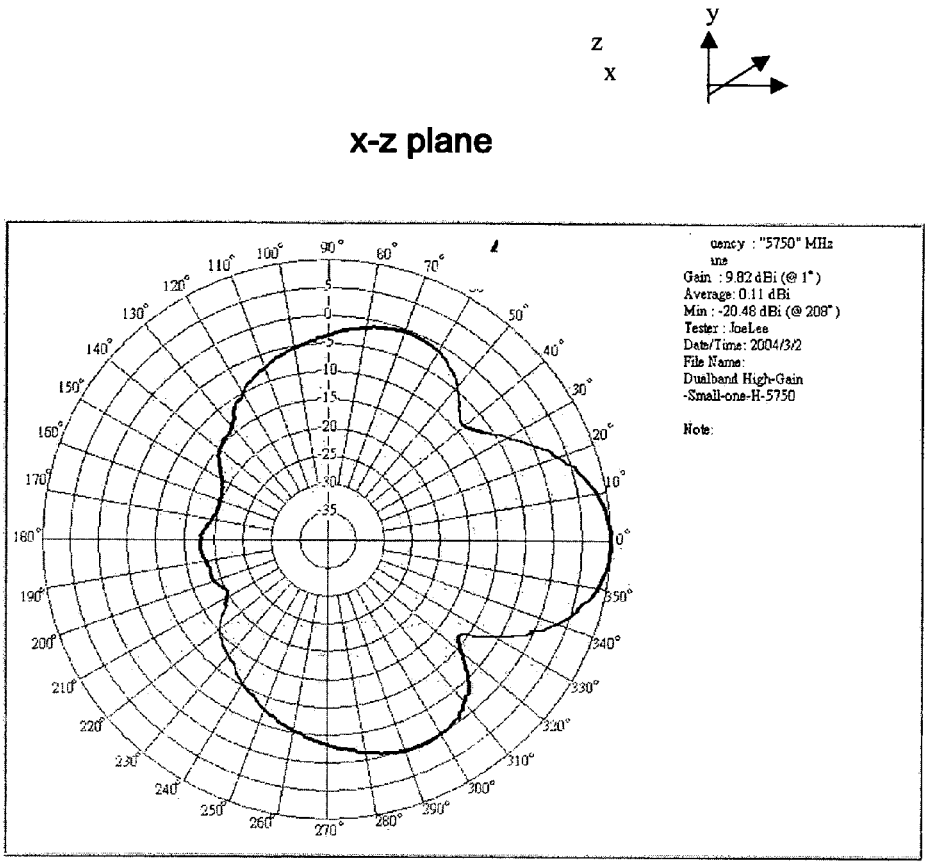
FIG. 4D illustrates the x-z radiation pattern under 5.750 GHz operation frequency according to the present invention.

Please refer to FIGS. 4A–4D, FIG. 4A shows the radiation pattern on the x-z plane during the operation of 2.450 GHz. FIGS. 4B–4C show the x-z plane radiation pattern under the operation of 4.9, 5.250 and 5.750 GHz, respectively. From the data, the x-z radiation pattern meets the requirements of the IEEE 802.11a/b/g and the HYPERLAN standard.

The benefit of the antenna includes simple structure, small size, low cost and omni-direction. The simple reflector may achieve the high gain and multi-band objects, thereby significantly reducing the manufacture cost.

Although specific embodiments have been illustrated and described, it will be obvious to those skilled in the art that various modifications may be made without departing from what is intended to be limited solely by the appended claims.

What is claimed is:

1. A multi-band antenna with a reflector, comprising:

a box-shape reflector including a base plate, a surrounding sidewalls and an extending plate, wherein said extending plate and said base plate are respectively attached on both sides of said surrounding sidewalls, thereby forming a box-shape with a receiving area on an inner surface of said base plate, and said extending plate being substantially parallel to said base plate; and a radiation unit coupled to said inner surface of said base plate and substantially parallel to said base plate by a predetermined distance.

2. The antenna of claim 1, wherein said extending plate is a frame structure.

3. The antenna apparatus of claim 1, wherein the material of said box-shape reflector includes conductive material.

4. The antenna apparatus of claim 1, wherein said multi-band antennal is adapted to 802.11a/b/g or HYPERLAN standard.

5. The antenna apparatus of claim 1, wherein said radiation unit is an omni-directional antenna.

6. The antenna apparatus of claim 1, wherein said radiation unit is a sleeve antenna.

7. The antenna apparatus of claim 1, wherein said distance is about 2–5 cm.

8. The antenna apparatus of claim 1, wherein said radiation unit is coupled to geometry center area of said base plate.

9. The antenna apparatus of claim 1, wherein the surface area of said receiving area is about one fourth of the one of said base plate.

10. The antenna apparatus of claim 1, wherein said radiation unit is shelter by said box-shape.

11. The antenna apparatus of claim 1, wherein the shape of said base plate is substantially square.

12. The antenna apparatus of claim 1, wherein the shape of said base plate is substantially rectangular.

* * * * *